US005093639A

United States Patent [19]

Franchi et al.

[11] Patent Number: 5,093,639

[45] Date of Patent: Mar. 3, 1992

[54] ELECTROMAGNETIC STRIPLINE COUPLER APPARATUS

[75] Inventors: Peter R. Franchi, Winchester; Nicholas P. Kernweis, E. Falmouth, both of Mass.

[73] Assignee: The United States of America as represented by the Secretary of the Air Force, Washington, D.C.

[21] Appl. No.: 585,835

[22] Filed: Sep. 20, 1990

[51] Int. Cl.[5] ..... H01P 5/00

[52] U.S. Cl. ..... 333/24 R; 333/35; 333/246

[58] Field of Search ..... 333/116, 24 R, 33, 35, 333/238, 246

[56] References Cited

U.S. PATENT DOCUMENTS

| | | | |
|---|---|---|---|
| 3,771,075 | 11/1973 | Phelan | 333/24 R |
| 4,080,579 | 3/1978 | Fassett | 333/246 X |
| 4,131,892 | 12/1978 | Munson et al. | 343/700 |
| 4,170,013 | 10/1979 | Black | 343/700 |
| 4,197,544 | 4/1980 | Kaloi | 343/700 |
| 4,486,758 | 12/1984 | de Ronde | 343/700 |

OTHER PUBLICATIONS

Gonda, *Transmission Line Couplers,* IBM Technical Disclosure Bulletin, vol. 4, No. 12, May 1962, pp. 49, 50.

*Primary Examiner*—Paul Gensler

*Attorney, Agent, or Firm*—Jacob N. Erlich; Donald J. Singer

[57] ABSTRACT

An electromagnetic stripline coupler apparatus having a pair of coupler units which are separated by a conductive ground plane with a slot in it that is aligned to pass signal energy between the coupler units.

13 Claims, 2 Drawing Sheets

ELECTROMAGNETIC STRIPLINE COUPLER APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to an electromagnetic coupler apparatus and, more particularly to a stripline feedthrough apparatus with an electromagnetic coupling.

The state of the art of electromagnetic coupling apparatus is well represented and alleviated to some degree by the prior art apparatus and approaches which are contained in the following U.S. Patents:

U.S. Pat. No. 4,131,892 to Munson et al. on 26 Dec. 1978;

U.S. Pat. No. 4,170,013 issued to, Black on 2 Oct. 1979

U.S. Pat. No. 4,197,544 issued to Kaloi on 8 Apr. 1980; and

U.S. Pat. No. 4,486,758 issued to de Ronde on 4 Dec. 1984.

The Munson et al. patent is directed to a stacked antenna structure for the radiation of orthogonally polarized signals utilizing a resonant circularly or ellipitically polarized microstrip radiator wherein the size of the radiator is reduced in the resonant or non-resonant dimensions, or both, without reducing the effective resonant dimension or substantially lowering the efficiency of the radiator. Reduction of the resonant dimension is provided by folding the resonant cavity, while reduction of the non-resonant dimension is facilitated by utilization of a low density, low loss dielectric, such that the loss resistance of the element is appreciable with respect to the radiation resistance of the element.

The Black patent discloses a stripline patch antenna which comprises a conformal antenna having a microstrip patch centered below a slot in a groundplane and covered by a dielectric window and coupled to a stripline feed.

The Kaloi patent describes a microstrip antenna system having two ground planes spaced apart by a dielectric substrate and radiation elements coplanar with one of the two ground planes or sandwiched within the dielectric substrate separating the two ground planes adjacent a window in one of the ground planes. The two ground planes are shorted together in most instances.

The de Ronde patent discusses an antenna element for coupling circularly-polarized radiation to a feedline. The element includes a pair of superposed planar dielectric layers. An outer surface of each layer is covered with an electrically-conductive layer forming a ground plane and having a circular opening defining respective cavities. Orthogonally-crossed dipoles are disposed between the dielectric layers and adjacent the openings for coupling radiation to the feedline through striplines also disposed between the dielectric layers.

Large conformal airborne phased arrays are increasingly projected as a future Air Force need. While many of the ultimate characteristics cannot be accurately predicted at the present time certain features are clearly desirable. One of the features is minimum extrusion to keep added air-drag as low as possible. Because space inside a surveillance aircraft is also at a premium, minimum intrusion is also highly desirable. For these reasons, phased arrays are envisioned with multiple planar configurations, that is, at the outermost plane would be the randome surface, then, the radiating surface, the phase shifter or T/R module surface, finally the beamforming network layer and mixed in within these layers would be DC power and digital control layers.

In order to achieve the above objective the principle concern is the RF feed coupling the RF power distribution network to the active or phase shifter layer. If these feed-throughs are metallic pins and there are a great number of them, both the difficuliy of assembling the networks and the expected power long-term reliability are very serious problems. Furthermore, another set of transverse wire connectors is required for mode suppression making the network assembly even more complex.

In the prior art, the conventional method for connecting one stripline type transmission line to another through multiple layers of dielectric and or conducting planes, consisted of terminating the center conductor of a stripline type transmission line by a pin at right angles to it which then connects to another stripline center conductor that neighbors the first stripline through a hole in the common ground plane (the upper ground plane of the bottom stripline is also the lower ground plane of the upper stripline).

When many layers of stripline are required these pin type connectors become buried (i.e. unacessible from outside). If a solder joint should break or weaken causing an open in the line or, under temperature or physical stress, the pin should short out against the hole in the ground plane, then correction is very difficult and costly. In addition, fabrication of multilayer strip transmission lines with solder connections of this type is both difficult and expensive.

While the above-cited references are instructive, there still remains a need to provide a method to measure the surface temperature of reacting and nonreacting materials. The present invention is intended to satisfy that need.

SUMMARY OF THE INVENTION

The present invention utilizes an electromagnetic coupling apparatus for coupling energy from one stripline transmission line to another stripline through the common ground plane between the striplines. The striplines are coupled by electromagnetic coupling through a longitudinal slot in the common ground plane. The coupler apparatus comprises three metallic ground plane sheets which are stacked upon each other and separated by dielectric material. The three sheets are continuous except that the middle sheet has a rectangular slot or hole in it. Stripline coupler unit:; are formed in the dielectric material between the ground planes. This thin metal line film coupler has a width that combined with the spacing between the ground plane of the two lower sheets and the dielectric determines the characteristic impedance of the stripline transmission line. Energy is transmitted into the apparatus on the lower stripline by means of a center conductor. Close to the coupling region, the center conductor widens for an impedance matching region which is a quarter wavelength long. This conductor width is maintained over the coupling region which is also a quarter wavelength long. Energy is coupled through the slot to the coupling region conductor of the upper stripline. This coupling method is reciprocal.

It is one object of the invention to provide an improved electromagnetic stripline coupler apparatus.

It is another object of the invention to provide an improved electromagnetic stripline coupler for connecting one stripline transmission line to another through multiple layers of dielectric and/or conducting planes.

It is another object of the invention to provide an improved electromagnetic stripline coupler converter apparatus which eliminates the need for metallic pins or flow through solder connectors to connect stripline transmission lines that are in different planes.

It is yet another object of the invention to provide an improved electromagnetic stripline coupler apparatus which utilizes electromagnetic coupling to couple energy from one stripline transmission line to another stripline through a longitudinal slot in the common ground plane between the two striplines.

These and other advantages, objects and features of the invention will become more apparent after considering the following description taken in conjunction with the illustrative embodiment in the accompanying drawings.

DESCRIPTION OF THE PREFERRED EMBODIMENT

Figure 1:
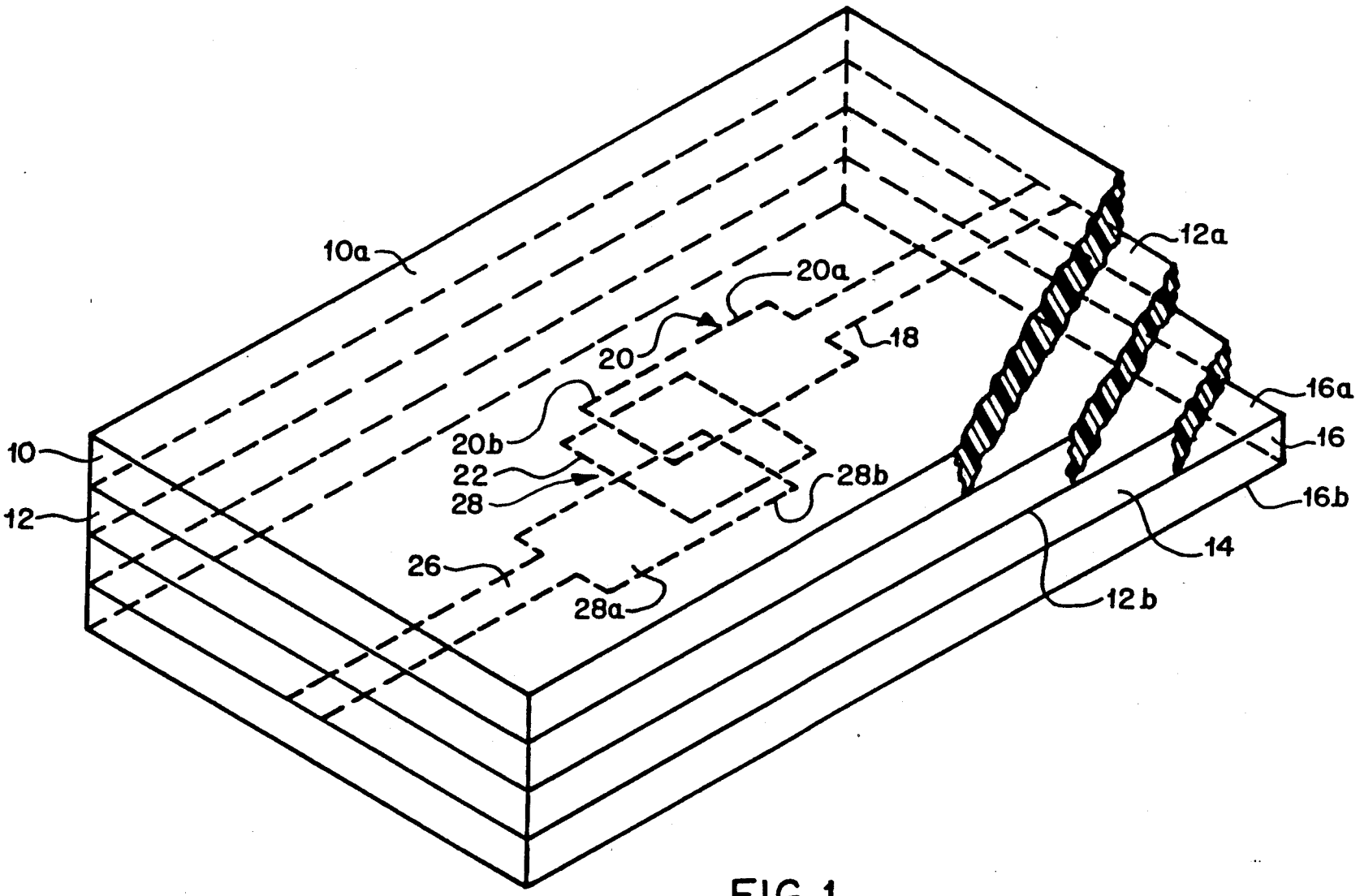
FIG. 1 is a perspective view, partially in section of the electromagnetic stripline coupler apparatus according to the present invention.

Referring now to FIG. 1 there is shown a perspective view of the electromagnetic stripline coupler apparatus which comprises multiple layers 10, 12, 14, 16. The layers or boards 10, 12, 14, 16 may comprise conventional copper clad printed circuit boards which have the circuit features, shown in FIG. 1, etched in their upper and lower surfaces. These circuit features will be addressed in greater detail in FIGS. 2*a* and 2*b* through 5*a* and 5*b*. The first board 10 has a conductive ground plane 10*a* over its entire upper surface. The lower surface of board 10 comprises a stripline transmission line 18 connected to a coupling unit 20. The coupling unit 20 which has an overall longitudinal length of $\lambda_\epsilon/2$, comprises a matching region 20*a* and a coupling section 20*b*. The matching region 20*a* and the coupling 20*b* are identical in length and both have a length equal to $\lambda_\epsilon/4$.

The board 12 has a conductive ground plane 12*b* over its entire lower surface and no conductive material at all on its upper surface 12*a*. A slot 22 is formed in the conductive ground 12*b* and is correspondingly aligned with the coupling section 20*b* of board 10. The slot 22 has a longitudinal length of $\lambda_\epsilon/4$. The width of the slot 22 is approximately 0.04 $\lambda_\epsilon$. Board 14 is comprised of a dielectric material, as are all of the other boards in the coupler unit, however, it does not contain any conductive cladding or ground planes on either its upper or lower surface.

The bottom board 16 has a conductive ground plane 166 on its lower surface. The upper surface 16*a* has formed thereon a stripline transmission line 26 which is connected to a coupling unit 28. The lower portion of the coupling unit 28 comprises a matching region 28*a* which has a longitudinal length of $\lambda_\epsilon/4$. The upper portion of the coupling unit 28 comprises a coupling section 28*b* which has a longitudinal length of $\lambda_\epsilon/4$. The matching region 28*a* is equal in length to the coupling section 28*b*. The overall longitudinal length of the coupling unit 28 is equal to $\lambda_\epsilon/2$. The coupling section 28*b* is correspondingly aligned with the slot 22 and the coupling section 20*b*.

Figure 2A:
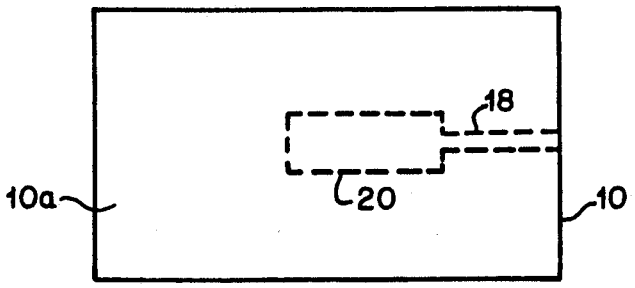
FIGS. 2*a* and 2*b* are top and side views, respectively, of the first layer of the multilayered stripline coupling apparatus.
Figure 2B:
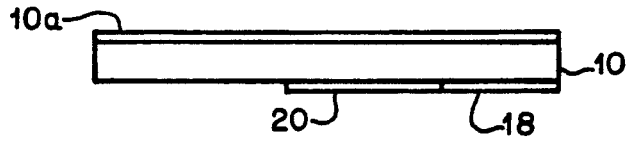
Figure 3A:
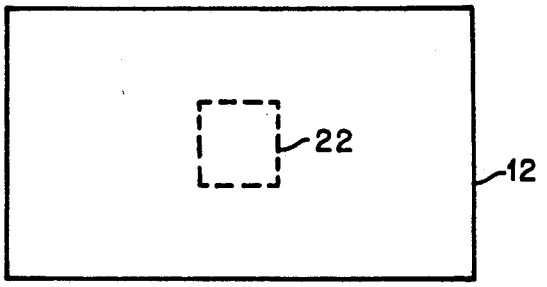
FIGS. 3*a* and 3*b* are top and side views, respectively, of the second layer of the multilayered stripline coupling apparatus.
Figure 3B:
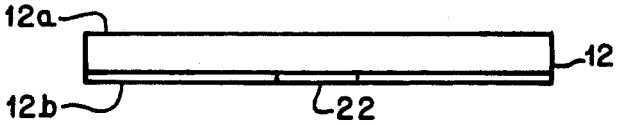

Turning now to FIGS. 2*a* and 2*b* there is shown respectively the top and side view of the first board 10 of FIG. 1. As shown in FIG. 2*b* the upper surface of board 10 is covered with a conductive ground plane 10*a*. The lower surface of board 10 contains a stripline transmission line 18 and a coupling unit 20. In FIGS. 3*a* and 3*b* there is shown the top and side views respectively of board 12. The upper surface 12*a* comprises only a dielectric surface while the lower surface 12*b* comprises a conductive ground plane with a slot 22 therein.

Figure 4A:
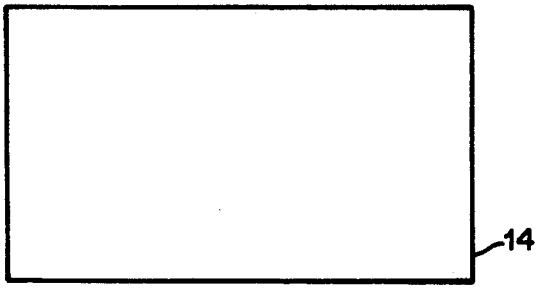
FIGS. 4*a* and 4*b* are top and side views, respectively, of the third layer of the multilayered stripline coupling apparatus, and, FIGS. 5*a* and 5*b* are top and side views, respectively, of the fourth layer of the multilayered stripline coupling apparatus.
Figure 4B:
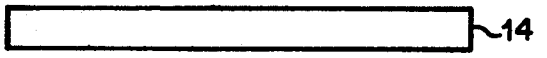

In FIGS. 4*a* and 4*b* there is shown respectively the top and side views of board 14. The board 14 comprises a printed circuit type board with the copper removed from both sides. Any type of dielectric spacer board may be utilized for board 14. Boards 10, 12 and boards 14, 16 may be viewed as dielectric spacers in the middle of which is formed first and second coupler units. The dielectric spacers are sandwiched between two ground planes with a ground plane separating them. The coupler units have a width that combined with the spacing between the ground planes and the dielectric constant of the two spacers determines the characteristic impedance of the stripline transmission line. A conventional stripline is represented by a metallic strip center conductor placed between two dielectric spacers which in turn are between two metal sheets.

Figure 5A:
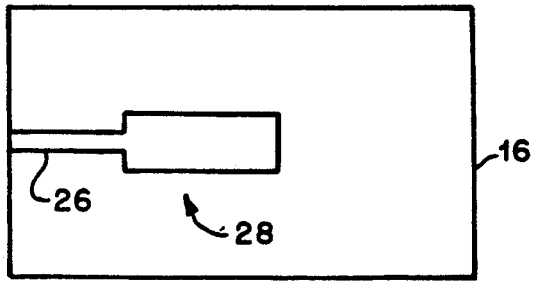
Figure 5B:
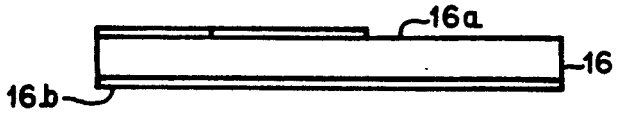

Turning now to FIGS. 5*a* and 5*b* there is shown respectively the top and side view of board 16. Board 16 is essential idential to board 10 with the exception that for use in the electromagnetic stripline coupler apparatus, boards 10 and 16 are positioned 180 degrees with respect to each other. Board 16 is fully clad with a conductive material such as copper on its lower surface 16*b* and has the stripline coupler unit 28 on it upper surface 16*a*. The stripline line transmission lines 18 (FIGS. 2*a*), and 26 (FIG. 5*a*) may be dimensioned to provide a desired characteristic impedance such as the conventional impedance of fifty ohms. It should be noted that the electromagnetic stripline coupler apparatus, as shown and described in FIGS. 1 through 5*b*, may be fastened together into the single unit shows in FIG. 1 by any suitable conventional fastening means such as screws, bolts, bonding or adhesive materials etc.

The operation of the electromagnetic stripline coupler apparatus is as follows. Energy is transmitted into the device on the lower stripline (FIG. 1,) with center conductor 26. Close to the coupling section, the center conductor widens for impedance matching over a length of one quarter wavelength. This conductor width is maintained over the coupling region which is also a quarter wavelength long. Energy is coupled through the slot 22 to the coupling region 20*b* of the upper stripline. That coupling section 20*b* passes energy through another impedance matching section 20*a* before energy exits on a conventional stripline sector represented by 18 which is part of the upper stripline transmission line. The apparatus is reciprocal, in that it may be operated in either direction. This apparatus allows complex multilayer stripline circuits to be fabricated very inexpensively and with little possibility of network failure.

The following equations apply:

$$\frac{1}{Z_{oe}} = \frac{1}{2}\left[\frac{1}{Z_{oo}} + \frac{1}{Z}\right] \quad (1)$$

where $Z_{oe}$ is the even mode characteristic impedance of the stripline, $Z_{oo}$ is approximately $Z_o$ the characteristic impedance of the stripline and $$Z = \frac{30}{\sqrt{\epsilon_r}} \frac{K(k')}{K(k)}$$

K is the complete elliptic integral of the first kind.

$$k = \sqrt{\frac{\cosh\frac{\pi W}{b} - 1}{\cosh\frac{\pi W}{b} + \cosh\frac{\pi d}{b}}} \quad (2)$$

where b is the thickness of the dielectric material between the ground planes, W is the width of the coupling section, d is the width of the slot, $$\text{and } K' = 1 - k^2 \quad (3)$$

If the length of the coupling section is $\beta_o l$ maximum coupling occurs when $\beta_o = \pi/2$. This gives an impedance of $Z_I$ $$Z_I = \frac{Zoe - Zoo}{2} \quad (4)$$

and $$l = \frac{\lambda_\epsilon}{4}$$

Since $Z_I$ will be smaller than $Z_o$, a quarter-wave matching section is needed at the input and output lines.

$$Z_m^2 = (Z_I Z_O)$$

where Zm is the impedance of the matching section. These equations together with FIG. 1 through 5*b* are sufficient to determine the dimension of a coupler for a given $\epsilon_r$ and ground plane separation, b. The design equations and a slot width restriction of 0.04 $\lambda_\epsilon$, where $\lambda_\epsilon$ is the wavelength in dielectric stripline, gives low coupler performance. The equations herein given may be found in Microwave Filters Impedance Matching Networks, and Coupling Structures by Mathei, Young and Jones, published by McGraw-Hill.

Although the invention has been described with reference to a particular embodiment, it will be understood to those skilled in the art that the invention is capable of a variety of alternative embodiments within the spirit and scope of the appended claims.

What is claimed is:

1. An electromagnetic stripline coupler apparatus comprising in combination:

a first substrate having a top and bottom surface, said top surface having a conductive layer formed thereon, said bottom surface having formed thereon a first elongated, open-circuited stripline coupling unit, said first stripline coupling unit receiving an input signal, a second substrate having a top and bottom surface, said top surface of said second substrate being aligned with and in contact with said bottom surface of said first substrate, said bottom surface of said second substrate having a conductive layer formed thereon with a slot formed therein, said slot being elongated and having its longitudinal axis aligned parallel with the longitudinal axis of said first stripline coupling unit, a third substrate having a top and bottom surface, said top surface of said third substrate being aligned with and in contact with said bottom surface of said second substrate, and a fourth substrate having a top and bottom surface wherein a conductive layer is formed on said bottom surface, said top surface of said fourth substrate having formed thereon a second elongated, open-circuited stripline coupling unit, said second stripline coupling unit being respectively aligned parallel with the longitudinal axis of said slot and said first stripline coupling unit, said second stripling coupling unit operatively coupled to said first stripling coupling unit through said slot of said second substrate to receive said input signal therefrom, said second stripline coupling unit providing an output signal.

2. An electromagnetic stripline coupler apparatus as described in claim 1 wherein said first, second, third and fourth substrates all have substantially the same thickness.

3. An electromagnetic stripline coupler apparatus as described in claim 1 wherein said first, second, third and fourth substrates comprise a dielectric material.

4. An electromagnetic stripline coupler apparatus as described in claim 1 wherein the conductive layers on said first, second and fourth substrates comprise a copper ground plane.

5. An electromagnetic stripline coupler apparatus as described in claim 1 wherein the width of said first and second stripline coupler units is substantially the same and is smaller than the width of said slot.

6. An electromagnetic stripline coupler apparatus as described in claim 5 wherein the width of said slot is $0.04\lambda_\epsilon$, where $\lambda_\epsilon$ is the wavelength in the dielectric stripline, and said width of said slot is the dimension which is perpendicular to the longitudinal axis of said first and second stripline coupler units.

7. An electromagnetic stripline coupler apparatus as described in claim 1 wherein said first and second stripline coupler units respectively comprise a stripline conductor operatively connected to a means for coupling signals.

8. An electromagnetic stripline coupler apparatus as described in claim 7 wherein said signal coupling means comprises a matching region and a coupling section, said matching region matches the impedance of said stripline conductor to the impedance of said coupling section.

9. An electromagnetic stripline coupler apparatus as described in claim 8 wherein said matching region and said coupling section are equal to each other in length and width.

10. An electromagnetic stripline coupler apparatus as described in claim 8 wherein said slot has a length equal to the length of said coupling section, said length of said slot and said coupling section are parallel to the longitudinal axis of said first and second stripline coupler units.

11. An electromagnetic stripline coupler apparatus as described in claim 8 wherein the length of said matching region and said coupling section are both equal to $\lambda_\epsilon/4$, where $\lambda_\epsilon$ is the wavelength of said input signal in the dielectric material.

12. An electromagnetic stripline coupler apparatus as described in claim 1 wherein the width of said slot is $0.04\lambda_\epsilon$, where $\lambda_\epsilon$ is the wavelength in the dielectric stripline, and said width of said slot is the dimension which is perpendicular to the longitudinal axis of said first and second stripline coupler units.

13. An electromagnetic stripline coupler apparatus as described in claim 12 wherein said slot has a length equal to $\lambda_\epsilon/4$, where $\lambda_\epsilon$is the wavelength in the dielectric stripline, said length of said slot is parallel to the longitudinal axis of said first and second stripline coupler units.

* * * * *